US005349133A

United States Patent [19]

Rogers

[11] Patent Number: 5,349,133

[45] Date of Patent: Sep. 20, 1994

[54] MAGNETIC AND ELECTRIC FIELD SHIELD

[75] Inventor: Wesley A. Rogers, Grosse Pointe Park, Mich.

[73] Assignee: Electronic Development, Inc., Grosse Pointe Park, Mich.

[21] Appl. No.: 962,892

[22] Filed: Oct. 19, 1992

[51] Int. Cl.[5] ..... H01B 7/34

[52] U.S. Cl. ..... 174/36; 174/106 R; 174/108

[58] Field of Search ..... 174/36, 105 R, 106 R, 174/108

[56] References Cited

U.S. PATENT DOCUMENTS

| | | | |
|---|---|---|---|
| 2,576,163 | 11/1951 | Weston et al. | 174/28 |
| 2,879,318 | 3/1959 | Straube | 174/36 |
| 4,816,614 | 3/1989 | Baigrie et al. | 174/36 |

FOREIGN PATENT DOCUMENTS

| | | | |
|---|---|---|---|
| 3123040 | 1/1983 | Fed. Rep. of Germany | 174/36 |
| 2428895 | 1/1980 | France | 174/36 |
| 570680 | 12/1975 | Switzerland | 174/36 |
| 1558962 | 1/1980 | United Kingdom | 174/36 |

*Primary Examiner*—Morris H. Nimmo
*Attorney, Agent, or Firm*—Davis Hoxie Faithfull & Hapgood

[57] ABSTRACT

A magnetic field and electric field shield having an electrically conductive layer and two layers of thin, soft magnetic material wrapped in opposite directions about a common axis. One layer of magnetic material is wrapped in a clockwise direction and the other layer of magnetic material is wrapped in the counter clockwise direction. The electrically conductive layer is grounded and provides a barrier to electric field penetration. The two layers of magnetic material oppositely wrapped provide a barrier to magnetic field penetration. An outer wrapping of material may be used to secure the magnetic wrappings in place. The shield is applicable to electric devices, in particular electrical wires and cables for automotive vehicles and other high current discharge operations.

32 Claims, 2 Drawing Sheets

MAGNETIC AND ELECTRIC FIELD SHIELD

FIELD OF THE INVENTION

This invention relates to shielding electrical devices, cables and wires, more particularly to providing a magnetic and electric shield for wires to minimize electromagnetic interference.

BACKGROUND OF THE INVENTION

It is known to provide electric shielding for wires to reduce the effects of electromagnetic radiation, both from the standpoint of coupling radiation into a electrical wire or device, and from the standpoint of preventing radiation emissions from an electrical wire or device. An electric field shield is typically obtained by placing an electrically conductive layer of material in electrical isolation around the electrical wire or device and connecting the conductive layer to ground. The conductive material may be, for example, a film, sheet, wire braid or wire mesh made of copper, aluminum or the like.

Wire braid is commonly used to shield electric cables and wires. One problem with the copper or tinned copper braid type of shield is that it does not attenuate magnetic fields. Rather, it reflects an incident magnetic field and may pass up to 90% of the incident magnetic field. This magnetic field can in turn induce currents which interfere with the normal operation of devices that are subjected to the passed magnetic field or connected to wires that are subjected to the passed magnetic fields.

Most wiring currently used in an automotive vehicle is copper wire. Due to the nature of the automotive vehicle, and its mechanical and electrical devices, there are large transient and cyclic current discharges. These discharges produce correspondingly large electromagnetic fields during the normal starting and running operation of the vehicle. These electromagnetic fields will interfere with the operation of the vehicle electronics and the electronic systems of adjacent vehicles or devices if the electronics and wiring harnesses are not properly shielded.

It is known to wrap electrical wires and devices with a magnetic material to shield the wire or device from magnetic fields. One problem with this technique is that the magnetic fields leak out the ends of the wrap and may leak through seams in the wrap. It is commercially impractable to wrap completely a magnetic shielding material about electrical devices and wires and to weld the seams closed.

Another known approach to shielding electrical devices uses laminate boxes to surround the electrical device. The laminate includes an outer layer of copper, a middle layer of stainless steel (e.g., type 430), and a inner layer of copper. The copper layers are secured to the stainless steel by interatomic bonding, e.g., electroless plating. The stainless steel has a permeability that acts as a magnetic shield. Such a laminate structure is available from Texas Instruments under the trade name TI-SHIELD.

One problem with the laminate sheet structure is that it is not suitable for shielding wires. In particular, the rigid laminate structure is not easy to wrap around wires of particularly small diameter or to shield structures that are not boxlike. Another problem is that the laminate structure prevents the stainless steel magnetic shielding material from forming a good stainless to stainless contact and a tight magnetic field seal. The copper layer to copper layer contact provides a magnetic field leakage path ground the edge of the stainless steel layer. Wrapping such a laminate helically around a cable also forces the magnetic flux to follow a helical path around the cable.

In the automotive environment, magnetically shielding wiring harnesses by the known techniques is particularly difficult because the shield must be installed on the wiring before the wiring is manipulated into place on the vehicle.

It is therefore an object of the invention to provide an improved magnetic field shield for wires and other devices that does not suffer from the defects of the known magnetic shields and shielding methods.

It is another object of the invention to provide a magnetic and electric field shield for flexible electric wires and cables. It is yet another object of the invention to provide a magnetic and electric field shield for electric wires suitable for use in an automotive vehicle.

SUMMARY OF THE INVENTION

The present invention provides a magnetic and electric field shield for electrical wire and devices. Broadly, one aspect of the invention is directed to a magnetic and electric field shield having a layer of high electrically conductive material that is to be connected to ground, and two layers of flexible magnetic shielding material.

The highly conductive layer is preferably a flexible metallic layer that is wrapped around the electrical wire or device to be protected, but not electrically connected to the electrical wire or device. It may be a solid sheet or film of a conductor, or it may be a wire braid or wire mesh having dimensions and spacing suitable to ground incident electric fields in the frequency range of interest, e.g., 10 KHz to 500 MHz. Suitable metal conductors include gold, silver, copper and aluminum, preferably copper for its lower cost, good conductivity, and good lifetime flexibility.

Each layer of magnetic material is made of a thin and flexible magnetic material that has a high permeability to absorb magnetic fields. One layer of magnetic material is helically wrapped in the clockwise direction extending from one end of the electrical wire or device to be protected to the other end along a longitudinal axis. The second layer of magnetic material is helically wrapped in a counterclockwise direction along the same longitudinal axis of the electrical wire or device to be protected and over the first layer of magnetic material.

In one embodiment, the two magnetic material layers are disposed adjacent in touching contact with their wraps in opposite helical directions. The two layers of magnetic material may be disposed outwardly of the electrically conductive layer and the inner-most magnetic layer may be in touching contact with the electrically conductive layer. With this construction, the grounded inner metallic layer provides a barrier to electric field penetration in either direction, and the two layers of magnetic material wrapped in opposite directions provide a barrier to magnetic field penetration in either direction. In other embodiments, the electrically conductive layer may be disposed outwardly of or between the two magnetic layers.

No insulation is required between the conductive metallic electric shield layer and the two layers of magnetic material wrapped around the electrical device.

The layers of magnetic material wrapping need not be grounded at either end. In addition, the device to be shielded is to be effectively insulated from the shielding layers, in particular from the metallic electric field shield layer that is connected to ground.

In a preferred embodiment, the magnetic material layers are made by wrapping an elongated strip of soft magnetic material having a length that is greater than its width, about the electrical device or wire so that the edges of the width overlap. The two magnetic layers thus may be formed from a continuous wrap of a single strip that is wrapped to form one layer having one helical direction and a second layer having the opposite helical direction. A single continuous strip is required to balance the magnetic flux in the two layers. Two separate strips of magnetic material may be used to form the two layers provided that they are joined at one end.

The wrapping of magnetic material is preferably performed so that each layer of material overlaps itself helically along the longitudinal axis of the wrap. Preferably, the extent of overlap is on the order of 50% of the width of the strip. However, wrapping with an overlap ranging down to 20% is suitable.

The overlapping advantageously provides for good magnetic material to magnetic material contact and provides the same even though the wire or device to be protected may be flexed. This provides a tolerance to movement so that the extent of overlap may vary during flexure and still maintain a good magnetic contact.

In another aspect of the invention, additional layers of clockwise and counter clockwise wraps of magnetic material may be applied to further improve the magnetic shielding. Each set of layers is electrically insulated from other sets for maximum attenuation.

In yet another aspect of the invention an additional layer of electrically conductive material may be provided inwardly or outwardly of two adjacent layers of magnetic material, and/or interposed between the first two (or any two) layers of magnetic material. The added conductive layer will further improve attenuation of the magnetic field by reflecting some of the incident magnetic field and, if grounded, further attenuate the incident electrical field. If the added grounded layer is interposed between magnetic layers, some of the magnetic field will be reflected back into the adjacent magnetic material and thereby be attenuated further.

BRIEF DESCRIPTION OF THE DRAWINGS

Further features of the invention, its nature and various advantages will be apparent from the accompanying drawings and the following detailed description of the invention, in which like reference numerals refer to like elements, and in which.

DETAILED DESCRIPTION OF THE INVENTION

Figure 1:
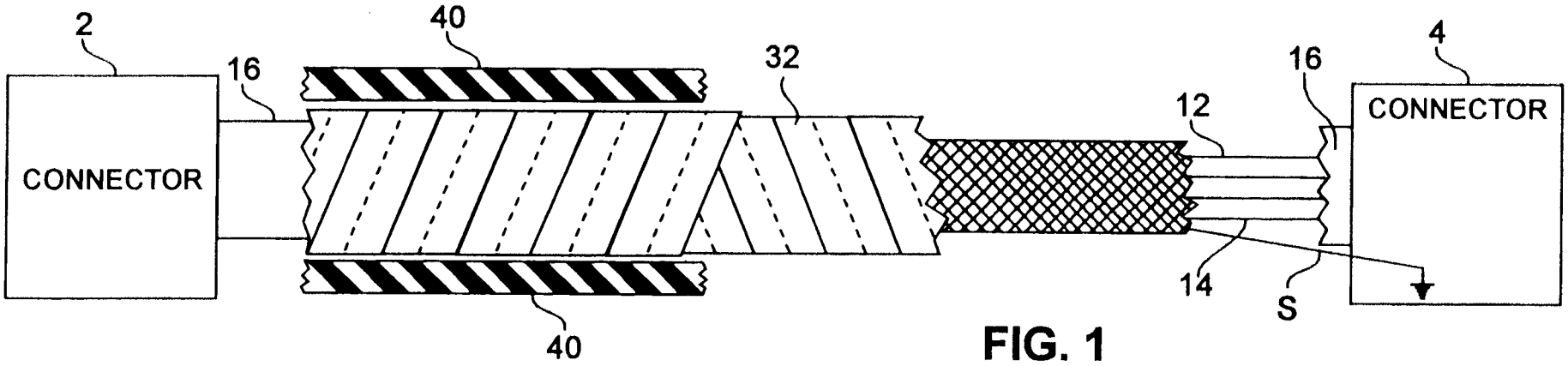
FIG. 1 is a perspective sectional view of an electrical cable wrapped with the magnetic and electric field shield of the present invention.
Figure 2:
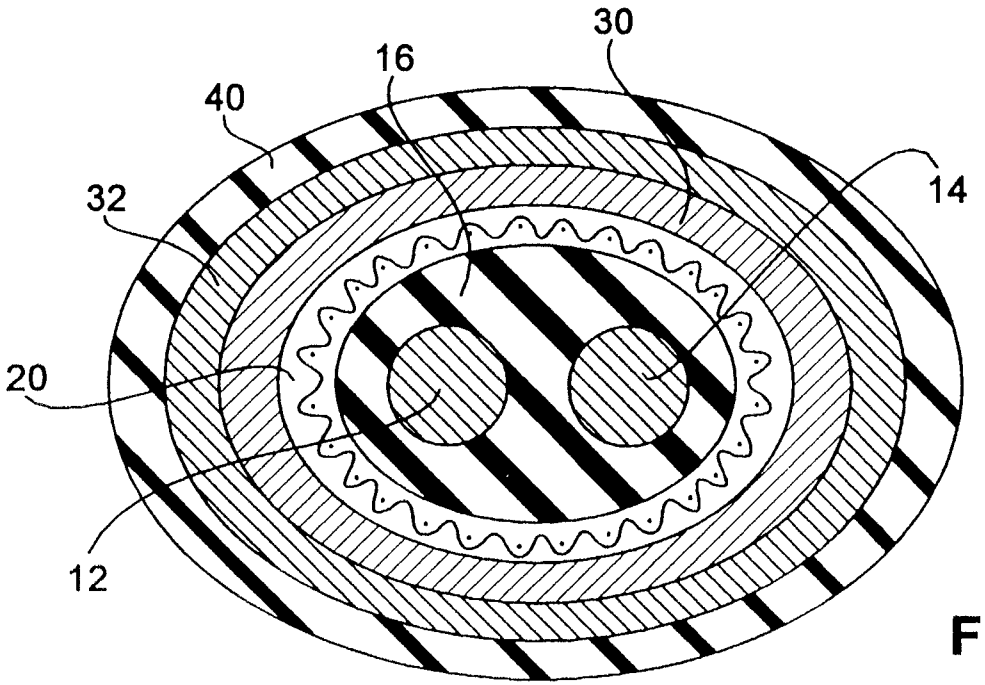
FIG. 2 is a cross section taken along line 2—2 of FIG. 1.

Referring to FIGS. 1 and 2, an electric and magnetic field shield in accordance with a preferred embodiment of the present invention is shown. In this embodiment, the electrical wire or device to be protected is a twin lead cable 10. Cable 10 has two wires 12 and 14 and a jacket 16. Wires 12 and 14 may be surrounded by an insulator material (not shown). Jacket 16 is an insulating material surrounding wires 12 and 14. Jacket 16 is surrounded by a braided wire 20. Braid 20 is a conventional tinned-copper braided shield having a minimum braid coverage of 95%, such as Alpha wires series 21XX braids. In this embodiment, cable 10 extends between connectors 2 and 4. Braid 20 is grounded at pin 5 of terminal connector 4 as illustrated in FIG. 1.

Overlying braid 20 is a first layer of soft magnetic material 30. Magnetic material 30 is shown wrapped with a 50% overlap uniformly along the longitudinal axis of cable 10. The 50% overlap is indicated by phantom lines in FIG. 1. A second layer of magnetic material 32 is wrapped over layer 30 in the opposite direction. In this embodiment, layer 32 starts from the end at which wrapping 30 begins, and also is wrapped in a helix to have the opposite helical direction. Layer 32 also is wrapped with a 50% overlap shown in phantom lines. Layer 30 is wrapped clockwise and layer 32 is wrapped counter-clockwise and the layers are joined at one end (not shown). The relative directions of wrapping are not important as long as they are sufficiently opposite as explained below. For each of layers 30 and 32 the magnetic material wrapping extends as close as possible to connector 2 without being electrically connected to ground or wires 12 or 14, and as close as possible to connector 4, also without being connected to ground or wires 12 or 14.

An outer sheath 40 of a conventional shrink tubing or other type of material may be applied to hold the wrapped magnetic layers 32 and 30 in place around electric shield layer 20. Alternately, a web of material and an adhesive material may be applied to outer layer 32 to secure it and the underlying layer 30 in place. Alternatively, an outer layer of copper braid may be used to serve the two magnetic layers wrapped in place. Preferably, the magnetic and electric field shield is covered with a layer of non conducting material.

It has previously been a general practice to wrap a magnetic material in one direction when attempting to shield cables. It has been discovered that this practice reduces the shielding effectiveness of the magnetic material. In this regard, a single wrap in one direction is intended to appear to the electromagnetic field incident on the wrap as a continuous path, from one end of cable 10 to the other end. However, all wraps have overlap areas which act as discontinuities in the magnetic path. These discontinuities provide magnetic resistance (reluctance) which causes a magnetomotive potential drop (MMF). The MMF is produced in a helical fashion (assuming a helical wrap in one direction) along the entire length of cable 10. This results in an effective antenna which radiates from each end of the magnetic material. Under appropriate conditions of frequency and MMF levels, the single magnetic material wrap also may radiate from its overlapped edges.

In accordance with the present invention, the deficiencies of a single layer wrap of magnetic material are overcome by providing a second wrap in the opposite direction. Importantly, the second wrap produces a helical antenna having the opposite polarity as the underlying wrapped layer of magnetic material. As a result, the two helical antennas having opposite polarity are balanced and cancel each other. Hence, the magnetic field emitted from the first layer is cancelled by the magnetic field emitted from the second layer.

The material to be used for the magnetic wrapping is selected as a compromise between the following factors: (1) permeability ($\mu = B/H$), (2) flux saturation level of the magnetic material, (3) the radius of the cable 10, (4) thickness of the magnetic material wrap, preferably selected from between 1 and 10 mils per layer, (5) absorption loss, (6) reflection loss, (7) resistivity and, (8) resistance and the magnetic resistance (select once) across the overlapped seams of the magnetic material. It is preferred to select the thinnest type of magnetic material providing the least path of magnetic resistance without saturating when subjected to a given magnetic field strength from the wires 12 and 14 of cable 10. Suitable magnetic materials include, but are not limited to, PERMALOYS, PERMENDURE, 49% and 80% nickel iron alloys, and silicon magnetic steels.

The magnetic material is preferably on the order of one to ten mils thick and on the order of one inch wide. This provides for a 50% overlap of one-half inch between wraps. As previously noted, additional layers of magnetic wrapping may be applied to increase the effectiveness of the magnetic shield. In addition, several layers of magnetic material may be used to provide the desired thickness of the magnetic field shield. In this regard, using thinner layers provides for easier wrapping of the cable being wrapped.

For these magnetic shields at low frequencies in the near field, the Shielding Effectiveness (SE) in dB is approximately:

$$SE_{dB} \approx 20 \log \left(1 + \frac{\mu_r t}{2r}\right)$$

$\mu_r$=relative permeability of the shield material (unitless)

t=shield thickness r=radius of cable being shielded

The terms r and t may have any units of length as long as they are the same. If we want 60 dB of magnetic shielding effectiveness, then:

$$60 \approx 20 \log \left(1 + \frac{\mu_r t}{2r}\right)$$

and $$\log \left(1 + \frac{\mu_r t)}{2r}\right) = 3$$

$$1 + \frac{\mu r t}{2r} = 10^3 = 1{,}000 \approx \frac{\mu_r t}{2r}$$

Hence, for r equal to one-half inch:

$$\mu l = 1{,}000\ (2r) = 1{,}000\ (2\tfrac{1}{2}) = 1{,}000''$$

This allows a design trade-off between magnetic material permeability $\mu_r$ and thickness t. The actual selection of the material is a matter of design choice.

Figure 3:
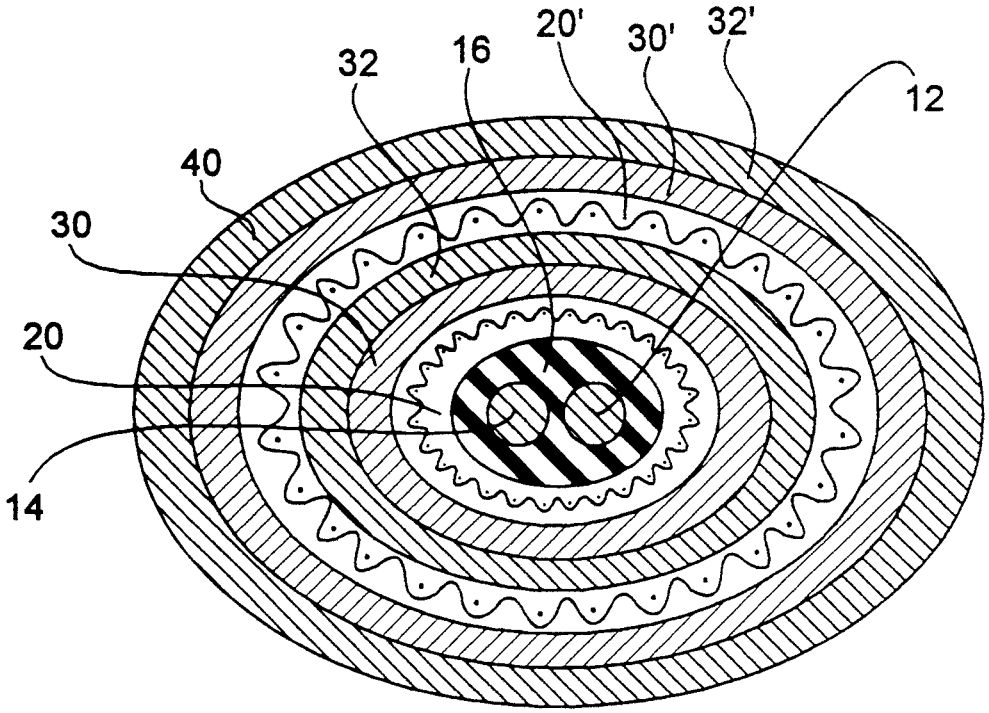
FIG. 3 is a cross section of an electrical cable wrapped with an alternate embodiment of the magnetic and electric field shield of the present invention.
Figure 4:
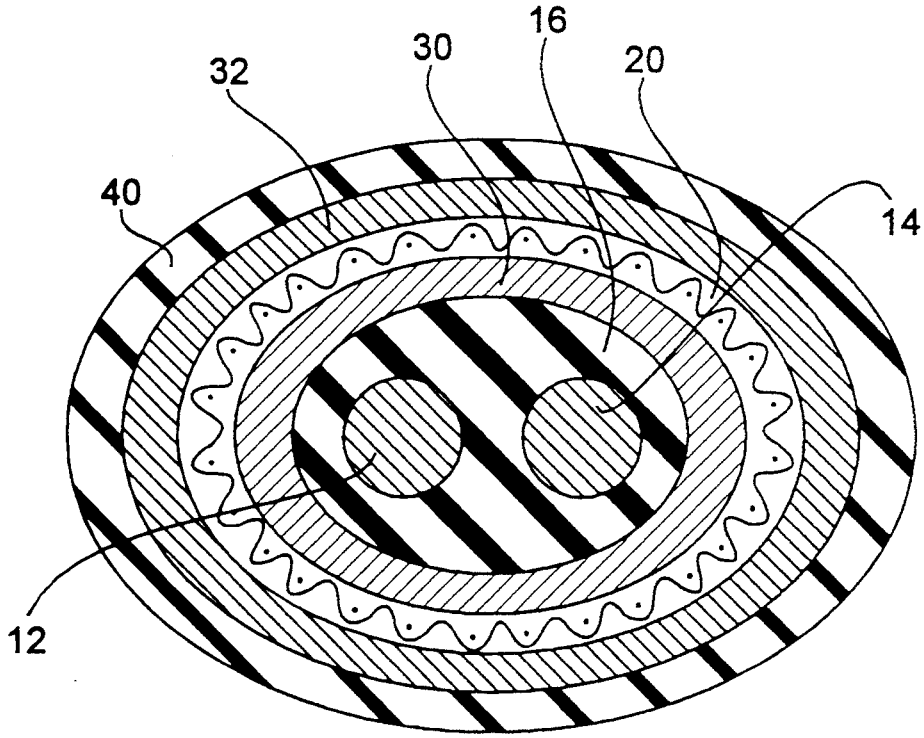
FIG. 4 is a cross section of an alternate embodiment of the magnetic and electric field shield of FIG. 1.

As shown in FIG. 3, an alternate structure of the shield of the present invention uses two pair of wrapped magnetic layers, namely layers 30 and 32, and layers 30' and 32' and two electrically conducting layers 20 and 20' (preferably tinned-copper braid), such that layer 20 is between the first magnetic layer 30 and the electric structure, and the layer 20' is between magnetic layers 32 and 30'. As shown in FIG. 4, an alternate embodiment of the shield of FIG. 1 provides that the electrically conductive layers 20 be interposed between magnetic layers 30 and 32.

In an alternate embodiment of the present invention (not shown), enhanced shielding may be obtained by interposing a second wrap of electrically conducted material, e.g., a tinned-copper braid layer, between the clockwise wrap of magnetic material layer 30 and the counter-clockwise wrap of magnetic material layer 32. The added electrically conductive material provides increased reflectivity to an incident magnetic field and greatly enhances the shielding effectiveness of the electric and magnetic shield illustrated in FIGS. 1 and 2. The second layer of copper material also is connected to ground.

In comparing the effectiveness of the shielding in accordance with the present invention, it is noted that in a given condition of noted electromagnetic interference (either susceptibility or emission) using only a single copper braided shield in the conventional manner provides 40 decibels of attenuation for all frequencies f less than c/(2.1) where c is the speed of light and 1 is the length of the cable in meters. This is the plane wave electromagnetic attenuation. The near magnetic field from the braid is negligible. Adding the two layers 30 and 32 of, for example, 10 mil thick 79 permalloy ($\mu_r$=50,000) magnetic material outwardly of the copper braid shield layer 20 significantly provides 60 dB of attenuation to magnetic fields from the previous formula. Adding a second layer of copper between the two magnetic wrapping layers provides an even greater attenuation on the order of 100 db.

Advantageously, the electric and magnetic field shield of the present invention may be used for wrapping wires and cables of any size, shape, configuration, and flexibility. The shield of the present invention is extremely thin and flexible. This makes it particularly suitable for use in environments, such as automotive vehicles, which contain electrical wires between batteries and electrical devices that carry current surges of between 60 and 200 amps, are flexed during installation, and are exposed to substantial and continuous vibrations for extended periods of time.

One skilled in the art will appreciate that the present invention can be practiced by other than the described embodiments which are presented for purposes of illustration and not of limitation.

I claim:

1. A magnetic and electric field shielded electrical structure comprising:

an electrical structure having a longitudinal axis;

a first layer of electrically conductive material surrounding the electrical structure in electrical isolation therewith;

a first layer of magnetic material surrounding the electrical structure, the first magnetic material layer being wrapped around the electrical structure in one of a clockwise and counter-clockwise direction with overlapped edges to form a helical path along the longitudinal axis of the structure; and a second layer of magnetic material wrapped around the first layer of magnetic material in the other of the clockwise and counter-clockwise directions with overlapped edges to form a helical path along the longitudinal axis of the structure, the first and second layers being connected at one end.

2. The apparatus of claims 1 wherein the overlap of the longitudinal edges of each of the first and second magnetic material layers is in the range selected from between 20 and 80%.

3. The apparatus of claim 2 wherein the overlap of the longitudinal edges of the first and second layers of magnetic material is on the order of 50%.

4. The apparatus of claim 1 further comprising an outer layer of material for holding the first and second layers of magnetic material wrapped about the electrical structure.

5. The apparatus of claim 1 wherein the electrical structure is a electrical cable having a length and the first and second layers are wrapped helically along the length in opposite helical directions.

6. The apparatus of claim 1 wherein the first and second layers of magnetic material are in touching contact.

7. The apparatus of claim 1 wherein the first layer of electrically conductive material is between the electrical structure and the first magnetic material layer and connected to ground.

8. The apparatus of claim 7 further comprising a second layer of electrically conductive material wrapped about the electrical structure and disposed outwardly of the first layer of magnetic material and connected to ground.

9. The apparatus of claim 7 wherein the first layer of electrically conductive material is copper.

10. The apparatus of claim 7 wherein the first layer of electrically conductive material is a wire braid.

11. The apparatus of claim 8 wherein the first and second layers of electrically conductive material are a wire braid.

12. The apparatus of claim 1 wherein each of the first and second magnetic layers is made of an elongated strip of magnetic material.

13. The apparatus of claim 12 wherein the elongated strips of magnetic material are between 1 and 10 mils thick.

14. The apparatus of claim 1 wherein the first and second layers of magnetic material are made of one continuous elongated strip of magnetic material.

15. The apparatus of claim 14 wherein the elongated strip of magnetic material has a thickness of between 1 and 10 mils.

16. The apparatus of claim 1 further comprising a third and fourth layers of magnetic material respectively wrapped in clockwise and counter-clockwise directions with overlapped edges along the longitudinal axis of the electrical structure, the third and fourth magnetic material layers being disposed outwardly of and superimposed over the first and second magnetic material layers.

17. The apparatus of claim 16 further comprising a second layer of electrically conductive material interposed between the second and third magnetic layers and connected to ground.

18. A method of forming an electric and magnetic field shield for an electrical structure having a longitudinal axis comprising the steps of:

a) wrapping a first layer of magnetic material in one of a clockwise and counter-clockwise directions along the longitudinal axis of an electrical structure to form a first helical wrap with overlapping edges;

b) wrapping a second layerof magnetic material over the first layer of magnetic material in the other of a clockwise and counter-clockwise directions along the longitudinal axis of the electrical structure to form a second helical wrap with overlapping edges, the first and second helical wraps being in opposite directions and forming a magnetic field shield; and c) providing the electrical structure with a first layer of electrically conductive material in electrical isolation therewith and connected to ground forming an electric field shield.

19. The method of claim 18 wherein the first electrically conductive layer is electrically isolated from the electrical structure and interior to the first and second helical wraps.

20. The method of claim 19 further comprising a second layer of electrically conductive material interposed between the first and second helical wraps.

21. The method of claim 18 wherein wrapping each of the first and second layers of magnetic material further comprises forming an elongated strip of magnetic material having a width and a length greater than the width and wrapping the length in a helix along the longitudinal axis so that the edges overlap by an amount in the range selected from between 20 and 80 percent.

22. The method of claim 21 wherein the overlap of the edges of the first and second magnetic material layers is on the order of fifty percent.

23. The method of claim 18 further comprising the steps of d) wrapping a third layer of magnetic material over the second layer of magnetic material in one of a clockwise and counter-clockwise direction along the longitudinal axis of the electrical structure to form a third helical wrap with overlapping edges; and e) wrapping a fourth layer of magnetic material over the third layer of magnetic material in the other of a clockwise and counter-clockwise direction along the longitudinal axis of the electrical structure to form a fourth helical wrap with overlapping edges, the third and fourth helical wraps being in opposite directions.

24. The method of claim 18 wherein step c) further comprises wrapping a copper or tinned-copper wire braid around the electrical structure.

25. The method of claim 19 wherein the magnetic material is selected from among the group consisting of permalloy, permendure, nickel-iron alloy, and silicon magnetic steels.

26. The method of claim 21 wherein the elongated strip of magnetic material has a thickness in the range of from between 1 and 10 mils.

27. The method of claim 26 wherein the magnetic material is selected from among the group consisting of permalloy, permendure, nickel-iron alloy, and silicon magnetic steels.

28. A method of shielding an electrical wire having a longitudinal axis from electrical and magnetic fields comprising the steps of:

surrounding an electrical wire with an electrically conductive layer of material in electrical isolation therewith;

connecting the electrically conductive layer of material to ground;

providing a first layer of magnetic material wrapped around the electrically conductive layer in one of a clockwise and counter-clockwise direction along the longitudinal axis of the electrical structure; and providing a second layer of magnetic material wrapped over the first layer of magnetic material in the other of clockwise and counter-clockwise directions along the longitudinal axis of the electrical structure.

29. The method of claim 28 wherein the first and second layers are made of strips of magnetic material connected at one end of the electrical wire having a thickness of between one and ten mils and an overlap in the range of 20 to 80 percent.

30. The method of claim 29 wherein each strip of magnetic material is on the order of one inch wide and the overlap is on the order of fifty percent.

31. The method of claim 28 wherein the first and second layers of magnetic material are formed from one continuous strip of magnetic material having a thickness of between one and ten mils and an overlap in the range of 20 to 80 percent for each of the clockwise and counter-clockwise directions.

32. The method of claim 31 wherein the strip of magnetic material is on the order of one inch wide and the overlap is on the order of fifty percent.

* * * * *

UNITED STATES PATENT AND TRADEMARK OFFICE

CERTIFICATE OF CORRECTION

PATENT NO. : 5,349,133

DATED : September 20, 1994

INVENTOR(S) : Wesley A. Rogers

It is certified that error appears in the above-indentified patent and that said Letters Patent is hereby corrected as shown below:

Column 5, line 10, "(select once)" should be --reluctance--;

Column 5, line 18 "PERMENDURE" should be --PERMENDUR--;

Column 5, line 58 "$\mu$1" should be --$\mu_r$t--;

Column 6, line 4 "layers 20" should be --layer 20--;

Column 8, line 1, "layerof" should be --layer of--.

Signed and Sealed this

Twenty-seventh Day of December, 1994

Bruce Lehman

*Attest:*

BRUCE LEHMAN

*Attesting Officer*

*Commissioner of Patents and Trademarks*